United States Patent [19]

Archibald

[11] Patent Number: 4,501,092

[45] Date of Patent: Feb. 26, 1985

[54] AUTOMATIC GRINDING

[75] Inventor: Ronald L. Archibald, Bushey, England

[73] Assignee: Staveley Machine Tools Limited, London, England

[21] Appl. No.: 417,840

[22] Filed: Sep. 14, 1982

[30] Foreign Application Priority Data

Sep. 15, 1981 [GB] United Kingdom ..... 8127827

[51] Int. Cl.[3] ..... B24B 49/00

[52] U.S. Cl. ..... 51/165 R; 51/72 L; 51/34 C; 51/216 ND; 51/92 ND; 51/165.71

[58] Field of Search ..... 364/474, 475; 51/165 R, 51/72 L, 216 ND, 92 ND, 34 C, 34 G, 35, 45, 165.87, 165.71; 76/37; 125/11 A

[56] References Cited

U.S. PATENT DOCUMENTS

| | | | |
|---|---|---|---|
| 3,646,593 | 2/1972 | Schubert | 51/165 R |
| 3,827,420 | 8/1974 | Hoglund | 125/11 A |
| 3,841,296 | 10/1974 | Ota | 51/165.87 |
| 4,112,626 | 9/1978 | Watanabe | 51/35 |
| 4,135,239 | 1/1979 | Hamill | 364/475 |
| 4,224,670 | 9/1980 | Yamazaki | 364/474 |

FOREIGN PATENT DOCUMENTS

| | | | |
|---|---|---|---|
| 2059832 | 4/1981 | United Kingdom . | |
| 2063734 | 6/1981 | United Kingdom | 76/37 |

*Primary Examiner*—Harold D. Whitehead

*Attorney, Agent, or Firm*—Banner, Birch, McKie & Beckett

[57] ABSTRACT

The invention is concerned with performing grinding operations on a workpiece at predetermined locations along its length and is described in connection with a machine for sharpening broaches in which a broach to be sharpened is mounted on a fixed bed, the positions of all the teeth on the broach are sensed by a probe during a first or forward pass of a work head along the whole length of the broach, the information so obtained is fed to a micro-processor and the broach teeth are sharpened in turn by a grinding wheel during a return pass of the work head along the broach using the information obtained by the sensing probe and input data fed initially into the micro-processor by means of a keyboard on a control panel.

6 Claims, 13 Drawing Figures

CONTINUOUS GRIND CYCLE – 0 – START POINT.
1 – RAPID TO FINE FEED.
2 – TOOTH DEPTH.
3 – SPARK OUT.
4 – BACK FEED.
5 – FINE TO RAPID FEED.
6 – CLEAR DIAM. & FACE.
7 – START POINT, NEXT TOOTH.

AUTOMATIC GRINDING

This invention relates to the grinding of workpieces by means of a grinding tool which operates at predetermined locations along each workpiece and the correct position of which, in relation to each location is automatically determined by a probe or sensing device operating in advance of the grinding tool.

It has already been proposed, in connection with the automatic sharpening of broaching tools, to mount both the grinding tool, in the form of a wheel, and the probe, for movement in the vertical and transverse directions relative to a longitudinally movable broach and it has also been proposed to provide a fixed bed for the broach and to move the grinding wheel and probe longitudinally thereof in addition to their vertical and transverse movements. In both cases, however, operation of the probe to sense the position of each tooth on the broach is performed in accordance with input data fed manually into the machine by means of thumb-wheels and is followed immediately by operation of the grinding wheel to sharpen that tooth before the probe is operated to sense the position of the next tooth.

It is the principal object of the present invention to reduce the time taken to complete a series of grinding operations with a high degree of accuracy and at the same time to minimise the wear on the moving parts of the grinding machine and to this end, according to a principal feature of the invention, a workpiece to be ground is mounted on a fixed bed, the locations at which grinding is to be performed are sensed during a first or forward pass of the probe along the whole length of the workpiece, the information so obtained is stored and grinding is performed at each location in turn during a return pass of the grinding tool along the workpiece using the stored information.

With this method of operation, the machine is not required to be of excessive length and can be made capable of bearing greater loads than one with a movable bed or table and the grinding tool and probe are not required to be operated alternately at each location along the whole length of the workpiece with the consequent wear and tear, particularly on the cross traverse slide.

According to a further feature of the invention, a machine for automatically performing a series of grinding operations at predetermined locations along a workpiece comprises a fixed bed to receive the workpiece, a sensing and grinding assembly mounted on said bed and comprising a first member movable longitudinally relative to said bed, a second member mounted on said first member for vertical movement relative thereto, a third member mounted on said second member for transverse movement relative to said second member and to said bed, a work head pivotally mounted on said third member for movement relative thereto about a substantially horizontal axis, a sensing probe and a grinding tool mounted in spaced relation on said work head and a central unit for controlling the operation of the individual elements of said sensing and grinding assembly in accordance with operating instructions and sensed information fed to and stored in a micro-processor to provide an initial sensing cycle in which said sensing and grinding assembly is moved in one direction along the entire length of the workpiece with said sensing probe operative to sense and record each location on the workpiece at which grinding is to be performed, followed by a grinding cycle in which said sensing and grinding assembly is moved along the workpiece in the opposite direction, with said grinding tool operative to effect the required degree of grinding at each location.

A preferred embodiment of the invention will be described with reference to the accompanying diagrammatic drawings in which.

Figure 1:
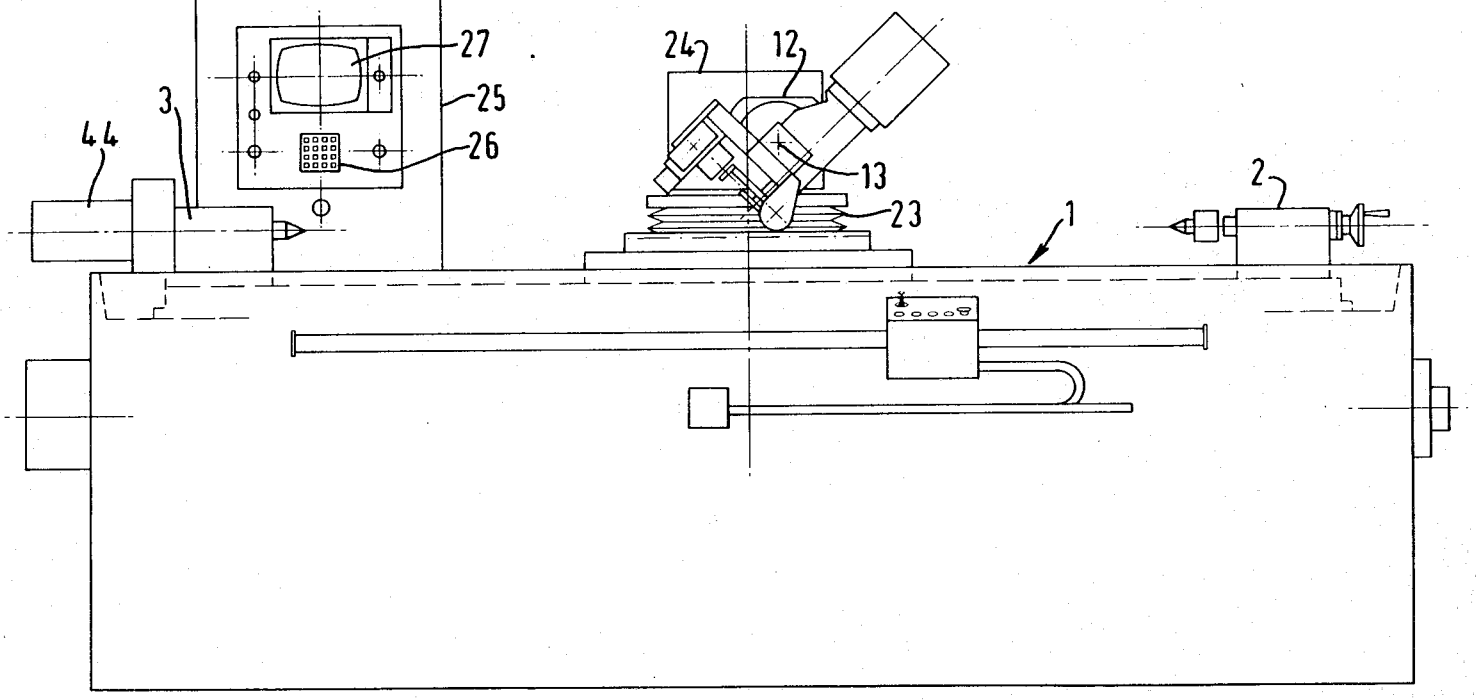
FIGS. 1 and 2 are elevational views from the front and rear respectively of a machine in accordance with the invention for sharpening broaches.
Figure 2:
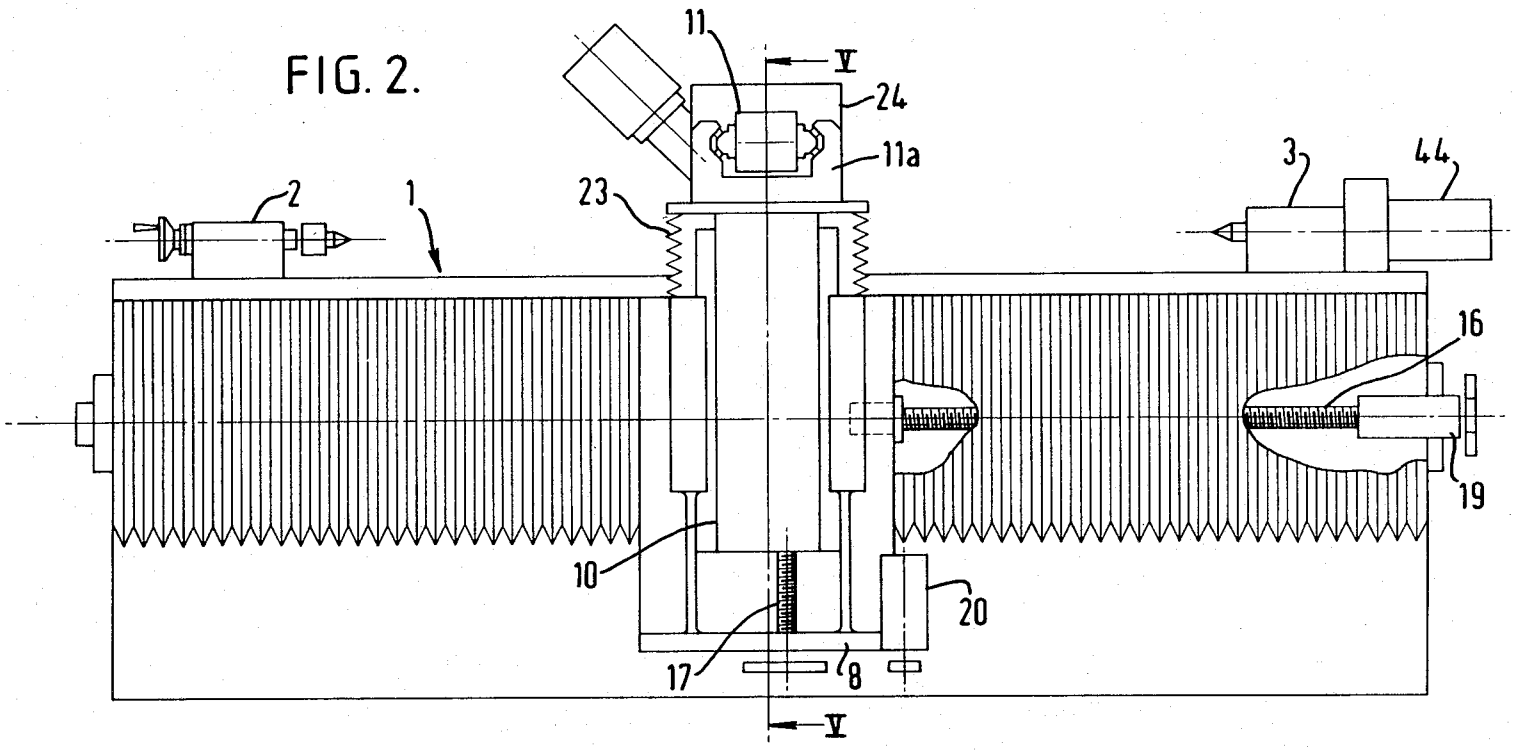

The machine illustrated in the drawings has a fixed bed and table, shown generally at 1, to receive and rigidly secure a broach to be sharpened. The bed is preferably moulded from synthetic granite for thermal stability and vibration damping and the table is preferably cast from Meehanite. For use with cylindrical broaches the bed/table 1 is preferably fitted with a headstock 3 and a tailstock 2, as shown in FIGS. 1 and 2, with the head stock driven by a stepping motor 44 through a toothed belt (not shown) while for use with surface broaches, the headstock and tailstock may be replaced by magnetic chucks 51 (FIGS. 5, 6 and 7) or other holding devices.

Figure 8:
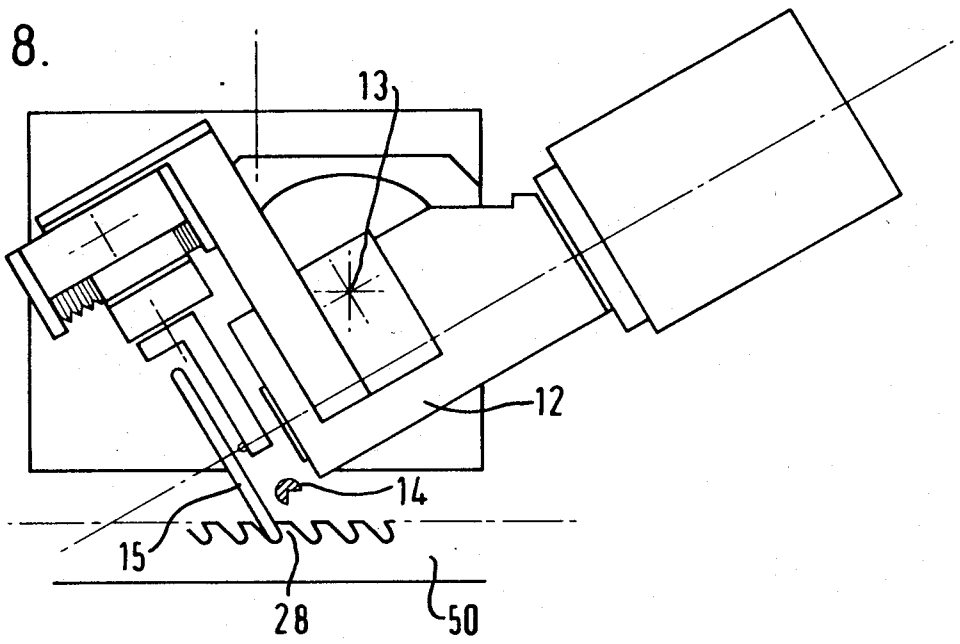
FIG. 8 is a side view looking from the right in FIG. 7.

The bed/table has a rear extension 4 (FIG. 5) provided with precision-hardened and ground guideways 5 and 6 which extend longitudinally of the bed/table and are fitted with rollers 7 to assist the movement aong the guideways of a slide 8 forming part of a movable assembly 9 for sensing and grinding the teeth of a broach 50 mounted on the bed/table. The assembly 9 also includes a vertical slide 10 movable in guideways (not shown) in the slide 8 and a cross traverse slide 11 running in guideways in a frame 11*a* carried by the upper end of the slide 10. A work head 12 is mounted at one end of the slide 11 for pivotal movement about an axis 13 (FIG. 8) extending parallel with the direction of movement of the slide 11 and provided with a sensing probe 14 and a grinding wheel 15 spaced from the probe 14 in the transverse direction of the bed/table 1.

This construction allows of a reduction in the overall length of the machine and an increase in the load-carrying capacity and stability of the bed/table as compared with a moving bed machine.

Figure 3:
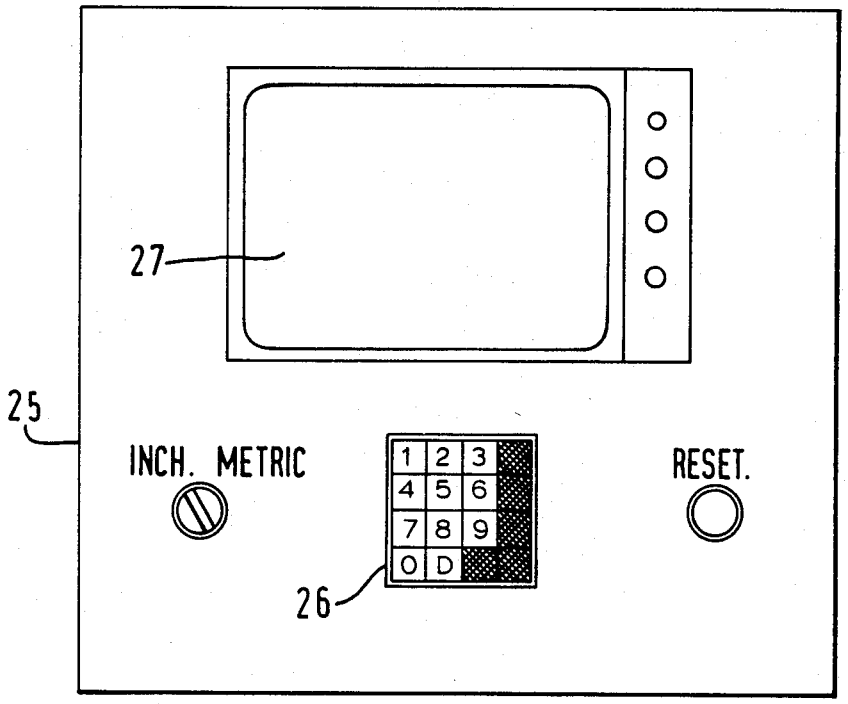
FIGS. 3 and 4 are enlarged front views of the control panel of a micro-processor and a typical video display of data fed thereto, respectively.
Figure 4:
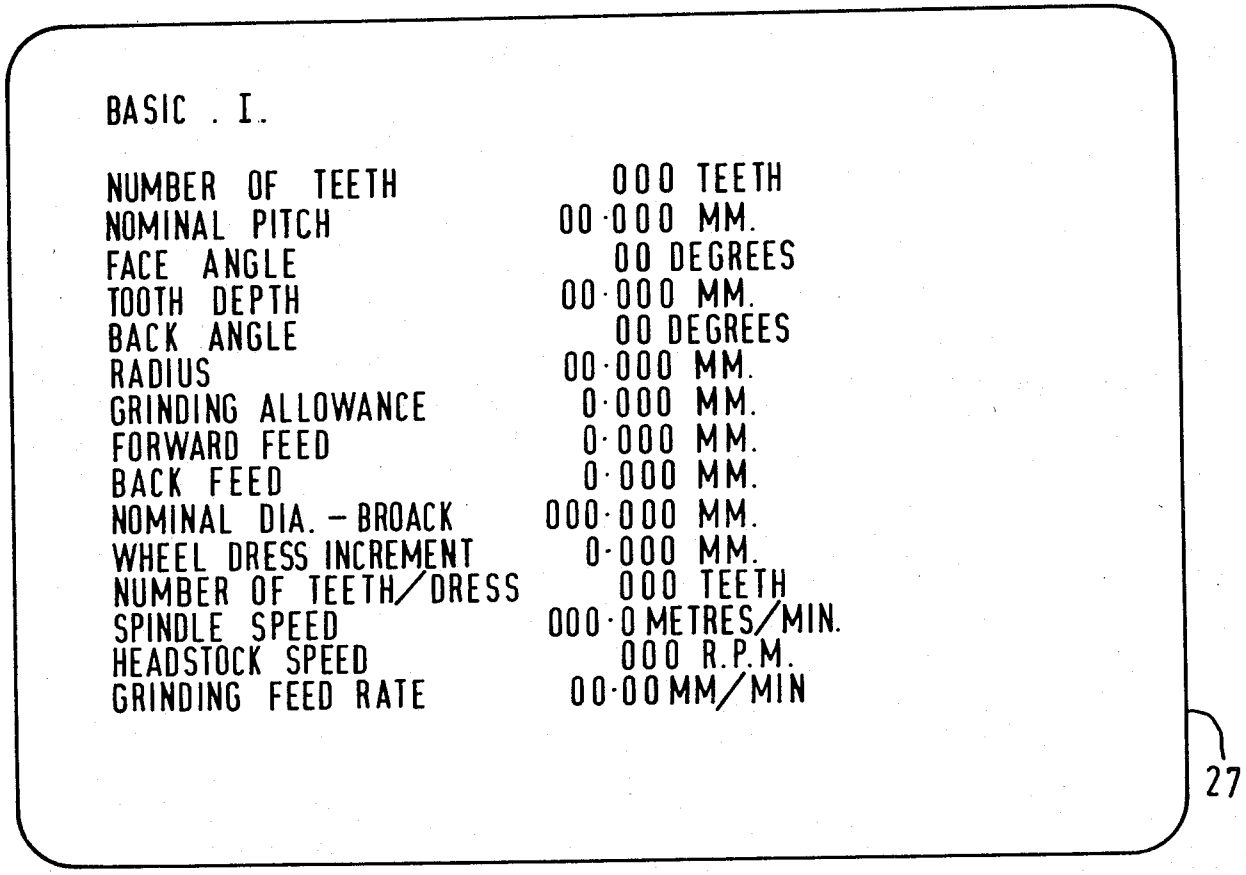

Movement of the slides 8, 10 and 11 is effected by ball-screw and nut mechanisms 16, 17 and 18 respectively, protected by concertina-type covers 22, 23 and 24 respectively and driven, via toothed belts (not shown), by stepping motors 19, 20 and 21 respectively, under the control of a control and drive unit 40 which also controls the stepping motor 44 and operates in accordance with signals received from a micro-processor having a control panel 25 provided with a keyboard 26 through which input data is initially fed in the form of an inter-active question and answer format and displayed on a video display unit 27 as shown in FIGS. 3 and 4.

To enable a constant amount to be removed from each tooth 28 on the broach 50 to be sharpened, irrespective of variations in the pitch of the teeth, the position of each tooth is sensed by the probe 14, likewise operatively connected to the control and drive unit 40, during a first or forward pass along the broach so that the positions of all the teeth are sensed and the information fed to and stored in the micro-processor prior to commencing a continuous grinding cycle on the return pass of the work head 12 along the broach. This procedure differs from existing methods in which each tooth is ground immediately after its position has been sensed and the employment of a continuous sensing cycle followed by a continuous grinding cycle reduces the overall time taken to sharpen the broach and reduces wear and tear on the cross traverse slide 11. With the method of the present invention stock removal can be preset to suit the condition of the broach to be sharpened.

Figure 9:
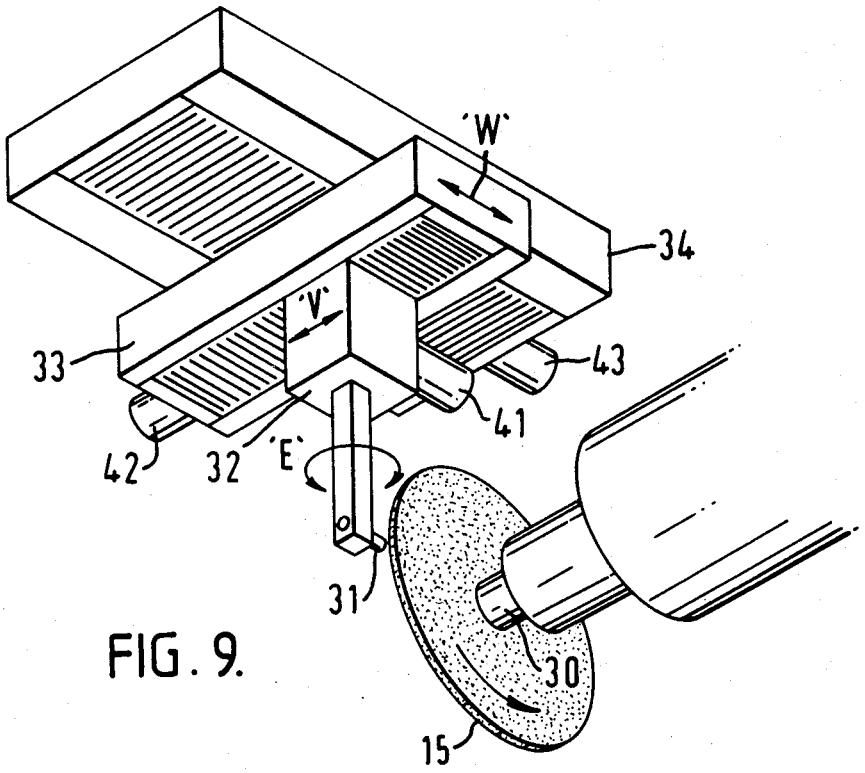
FIG. 9 is a perspective view of a dresser for the grinding wheel.
Figure 10:
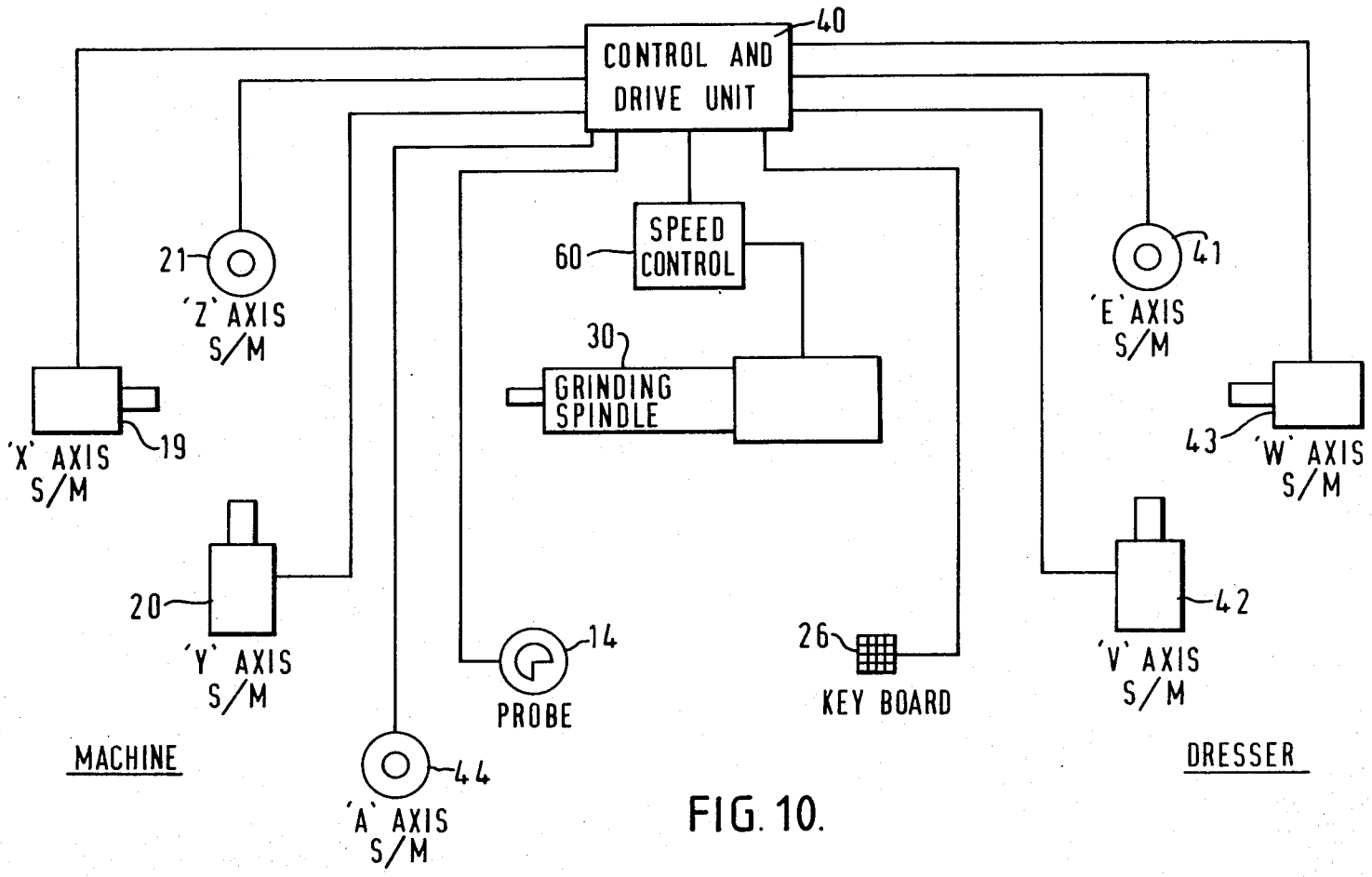
FIG. 10 is a schematic block diagram illustrating the control and drive unit and its connections to the sensing and grinding assembly and the wheel dresser.

The grinding wheel 15 is mounted on a liquid-cooled spindle 30, the speed of which can be infinitely varied over a range of from 1800 to 18000 r.p.m. by a speed-control unit 60 interposed in the driving connection between the control and drive unit 40 and the spindle 30. The machine is preferably provided with an automatic diamond wheel dresser 31 (FIG. 9) for the grinding wheel 15. The wheel dresser 31 is mounted for rotation in the direction of the arrows E in a carriage 32 movable in the direction of the arrows V in a carriage 33 which is, in turn movable in the direction of the arrows W on a guide 34. Rotational movement of the dresser 31 is effected by a stepping motor 41 and linear movement of the dresser in the directions V and W is effected by stepping motors 42 and 43 respectively. The stepping motors 41, 42 and 43 are operated by the control and drive unit 40 under the control of the micro-processor which is programmed through the keyboard 26 in accordance with the profile of the grinding wheel employed and to fully compensate for increments of wheel dressing. The speed control unit 60 for the grinding spindle 30 has access to the dresser data through the control and drive unit 40, the speed of the grinding spindle being determined by surface speed requirements after compensation for reduction in the diameter of the wheel as a result of dressing.

Grinding is performed wet for optimum results and grinding fluid is continuously filtered in a free-standing unit (not shown).

Figure 5:
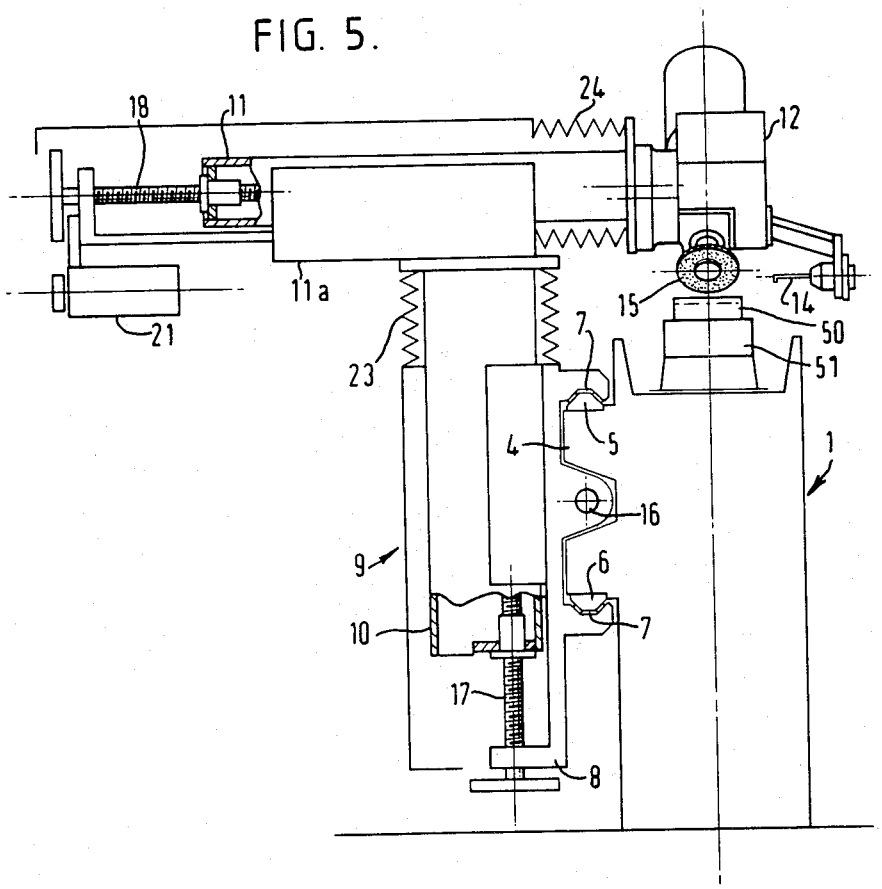
FIG. 5 is a section on the line V—V of FIG. 2, showing the grinding tool in the form of a wheel positioned above a broach to be sharpened.
Figure 7:
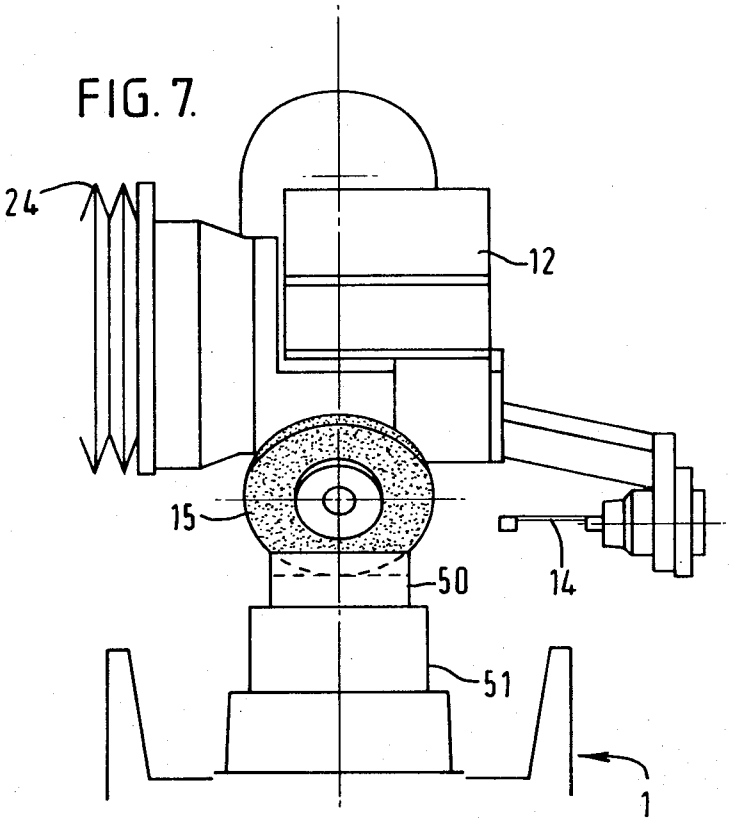
FIGS. 6 and 7 are enlarged detail views corresponding to FIG. 5, showing the sensing probe and the grinding wheel respectively, in operative position with respect to the broach.
Figure 6:
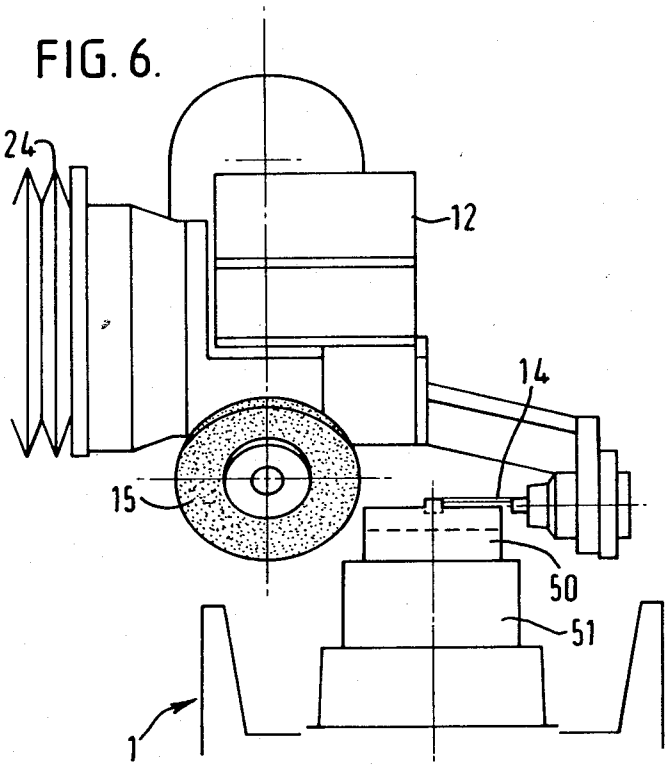

The machine will perform face and gullet grinding with backing-off operations on all types of surface and form broaches using a magnetic chuck 51 or other holding device as shown in FIGS. 5, 6 and 7 on cylindrical broaches using a headstock 3 and compensated tailstock 2, as shown in FIGS. 1 and 2. It can also be used, with the appropriate form of grinding tool, for performing other operations, e.g. cylindrical grinding and spline grinding.

Figure 11:
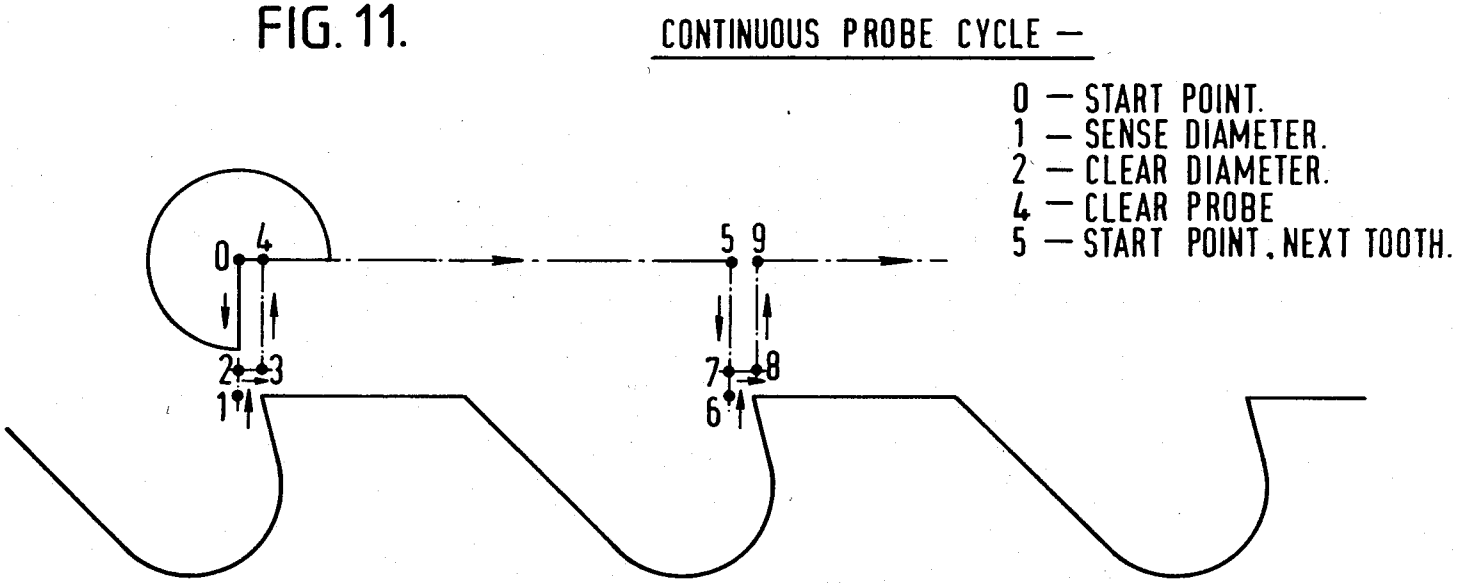
FIGS. 11 and 12 illustrate a sensing cycle and a grinding cycle respectively for a cylindrical broach.
Figure 12:
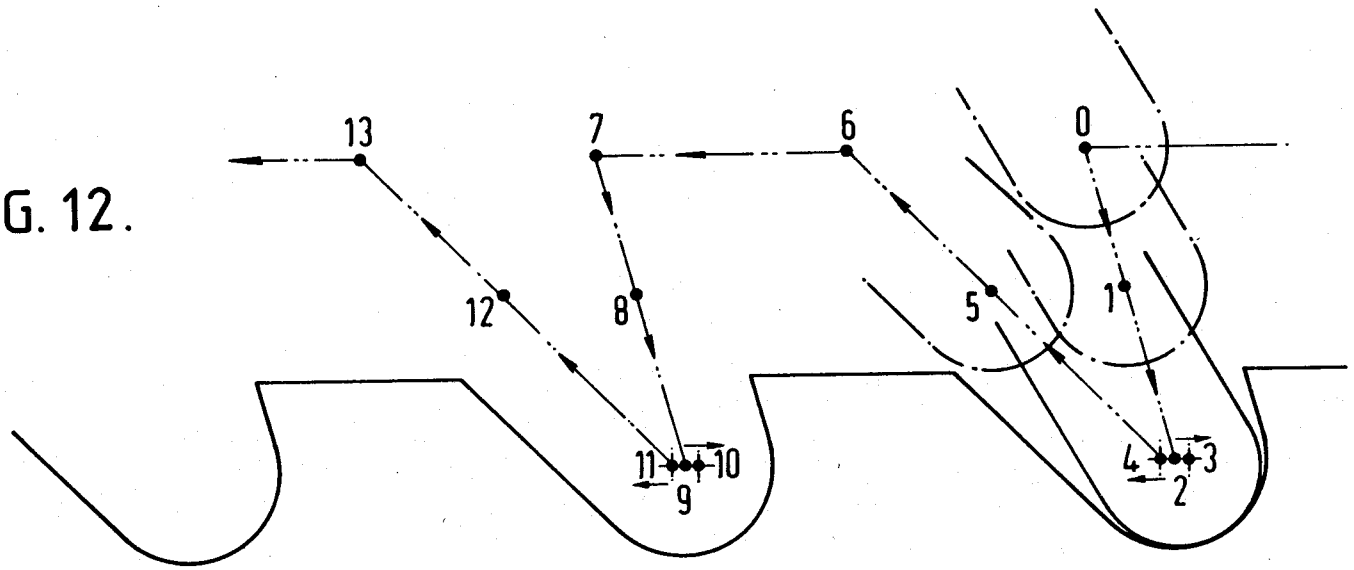
Figure 13:
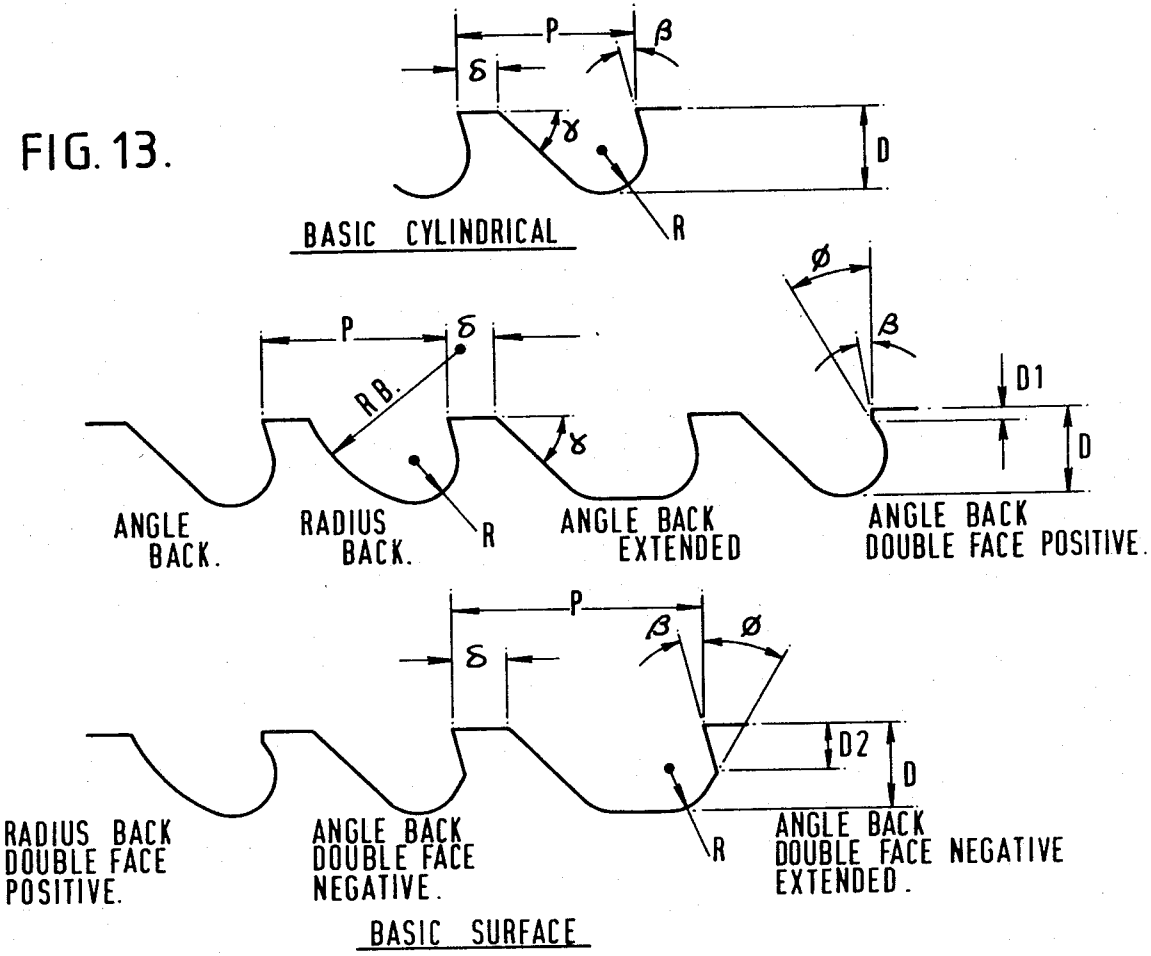
FIG. 13 shows various forms of broach teeth which may be sharpened by means of the invention.

FIGS. 11 and 12 illustrate typical continuous probe and grind cycles which can be employed with the machine according to the invention and FIG. 13 illustrates some examples of tooth forms which can be ground by the machine of the invention.

I claim:

1. A machine for automatically performing grinding operations at predetermined locations along a workpiece comprising: an elongated fixed bed provided with means to receive and secure the workpiece to said bed against axial displacement relative to said bed, a sensing and grinding assembly mounted on said bed, said assembly including a first member mounted to be movable longitudinally relative to said bed, a second member mounted on said first member to be movable in a substantially vertical direction relative to said first member, a third member mounted on said second member to be transversely shiftable relative to both said second member and to said bed, a work head pivotally mounted on said third member to be rotatable relative to said third member about a substantially horizontal axis, a sensing probe and a grinding tool mounted in spaced relation on said work head, a central control unit including a micro-processor for controlling the operation of the individual elements of said sensing and grinding assembly in accordance with operating instructions and sensed information recorded in said control unit, means activated by said control unit for moving said sensing and grinding assembly in one direction along the entire length of the workpiece secured to said bed,, means operating said sensing probe during movement of said assembly in said one direction to sense and record in said control unit each location at which grinding is to be performed, means activated by said control unit for moving said sensing and grinding assembly along said workpiece in the opposite direction, and means operating said grinding tool during movement of said assembly in said opposite direction to effect the required degree of grinding at each recorded location sensed by sensing probe during movement in said one direction.

2. A machine according to claim 1, wherein said first, second and third members are slides operated by ball-screw and nut mechanisms driven by stepping motors under the control of said central unit.

3. A machine according to claim 2, wherein said grinding tool includes a grinding wheel and said machine is provided with a dresser for said grinding wheel mounted relative to said bed, said dresser being rotatably mounted on a first carriage which is mounted for linear movement on a second carriage movable in a direction substantially at right angles to the direction of movement of said second carriage, the rotational movement of said dresser and the linear movement of said carriages being controlled by said central unit in accordance with data relating to the grinding wheel and fed into said micro-processor.

4. A machine according to claim 3, wherein the individual elements of said wheel dresser are operated by stepping motors under the control of said central unit.

5. A machine according to claim 3 or 4, wherein the speed of said grinding wheel is controlled by a speed control unit interposed between said central control unit and said grinding tool, said speed control unit having access to data fed into the micro-processor relating to the wheel-dressing operation.

6. A machine according to claim 1, wherein said means to receive and secure a workpiece is constructed to hold a broach to be sharpened, said sensing probe is operative to sense and record the position of every tooth on the broach, and said grinding tool includes a grinding wheel.

* * * * *